United States Patent [19]

Stevens et al.

[11] 4,313,978

[45] Feb. 2, 1982

[54] ANTISTATIC COMPOSITIONS AND TREATMENT

[75] Inventors: John Stevens; John S. Huizinga, both of Saint Paul, Minn.; Stephen Newman, Harlow, England

[73] Assignee: Minnesota Mining and Manufacturing Company, St. Paul, Minn.

[21] Appl. No.: 99,638

[22] Filed: Dec. 3, 1979

[30] Foreign Application Priority Data

Dec. 20, 1978 [GB] United Kingdom ..... 49359/78

[51] Int. Cl.[3] ..... B05D 3/02

[52] U.S. Cl. ..... 427/384; 252/88; 252/500; 252/546; 252/547; 260/DIG. 15; 260/DIG. 20; 427/396; 427/397; 428/64; 428/96; 430/961

[58] Field of Search ..... 427/384, 396, 397; 252/546, 547, 88, 500; 260/DIG. 20, DIG. 15, DIG. 19

[56] References Cited

U.S. PATENT DOCUMENTS

| | | | |
|---|---|---|---|
| 2,626,876 | 1/1953 | Carnes | 260/DIG. 20 |
| 2,626,877 | 1/1953 | Carnes | 260/DIG. 20 |
| 3,723,512 | 3/1973 | Niederprum et al. | 260/DIG. 20 |
| 3,767,625 | 10/1973 | Oxenrider et al. | 260/DIG. 19 |
| 3,899,563 | 8/1975 | Oxenrider et al. | 260/DIG. 19 |
| 3,931,080 | 1/1976 | Hammer et al. | 260/DIG. 19 |
| 4,096,079 | 6/1978 | Pardee | 252/51.5 R |
| 4,175,969 | 11/1979 | Mackey | 260/DIG. 15 |

*Primary Examiner*—Shrive P. Beck
*Assistant Examiner*—Janyce A. Bell
*Attorney, Agent, or Firm*—Cruzan Alexander; Donald M. Sell; Mark A. Litman

[57] ABSTRACT

A method of treating a surface, e.g. carpet, gramophone record, to reduce the static charging thereon which comprises applying a novel antistatic composition comprising a fluorinated anionic surfactant which is an amine salt of an acid containing a fluorinated organic radical and an antistatic agent which is an ionic salt of an amine, preferably in alcoholic solution.

30 Claims, No Drawings

ANTISTATIC COMPOSITIONS AND TREATMENT

This invention relates to antistatic compositions and in particular to antistatic compositions which are effective on irregular surfaces, e.g. records and carpets.

The use of ionic materials coated onto the surface of electrically non-conducting materials is a known method for allowing the neutralisation of electrostatic charges. This process relies on the absorbtion by the coating, of sufficient water from the environment to form an electrically conductive layer. The ionic solution must provide a continuous conductive path between the area where electrostatic charge is generated and the point of electrical neutrality. In general, ionic antistats provide good conductivity at high humidity, but under low humidity conditions the conductivity is poor.

One of the major difficulties with ionic antistats is to form and maintain a continuous conductive film. Two effects lead to loss of conductivity. The first is the difference in surface energy between the aqueous solution of the antistatic agent and the generally non-polar surface of the electrical insulator. Secondly, due to the absorbtion and desorption of water during changes in relative humidity, ionic coatings tend to crystallize, again fracturing the coating.

These difficulties can be overcome to a certain extent by increasing the coating weight of the antistatic agent or by use of a polymeric material which has ionic centres attached to the polymer chain. However, such measures can detract from the use of an antistatic coating, for example, if the treated surface is transparent or highly reflective then surface defects such as smears or fingerprints become visible.

The formation and maintenance of continuous coatings of antistatic agents is particularly difficult on surfaces which are roughened or grooved, so as to present sharp edges at the surface. These edges increase the tendency of aqueous films to retract under the force of surface tension and break the continuity of the conductive layer. The effect can be overcome by increasing the coating weight, but if the surface irregularities represent stored information, as in the case of gramophone records, then thick coatings obscure the stored information and inhibit accurate retrieval.

Similarly, if the surface is a fibrous mat or carpet, thick coatings of antistatic agents seriously detract from the normal use and appearance of these materials.

The use of antistatic agents such as fatty acid esters, amines and quaternary ammonium salts in conjunction with polymeric fluorocarbon compounds as a treatment for reducing the friction and wear on gramophone records is disclosed in United States Pat. No. 4,096,079. Such compositions are commercially available under the trade name Soundguard.

It is an object of the present invention to provide a new antistatic composition which is capable of providing a durable antistatic film on irregular surfaces.

According to the present invention there is provided an antistatic composition comprising a fluorinated anionic surfactant which is an amine salt of an acid containing a fluorinated organic radical (as defined herein) and an antistatic agent which is an ionic salt of an amine.

It has been found that the combination of the above fluorinated surfactant and antistatic agent can provide a low noise antistatic coating on gramophone records and a reduction in static charging on other surfaces, e.g. carpets, at very low application rates.

The surfactants used in the present invention are anionic fluorocarbon surfactants which are the amine salts of acids containing a fluorinated organic radical. The preferred surfactants may generally be depicted by the formula:

$$R_f\text{-}A\text{-}X^{\ominus}Z^{\oplus}$$

in which $R_f$ represent a fluorinated organic radical (as defined herein),

A represents a bond or a divalent linking group, $X^{\ominus}$ represents an acid anion, and $Z^{\oplus}$ represents a quaternary ammonium cation.

The fluorinated organic radical $R_f$ is defined as a radical which is a saturated, aliphatic radical having from 2 to 20 and preferably at least 3 carbon atoms, the skeletal chain of which may be straight, branched or if sufficiently large cycloaliphatic, the skeletal chain may be interrupted by divalent oxygen or trivalent nitrogen atoms bonded only to carbon atoms provided the radical does not contain more than one heteroatom, i.e. nitrogen or oxygen, for every two carbon atoms in the skeletal chain the radical being fully fluorinated with the exception that it may contain hydrogen or chlorine atoms as substituents provided that not more than one atom of either is present in the radical for each carbon atom. Preferably, the fluoroaliphatic radical is a perfluoroalkyl radical having a skeletal chain that is straight or branched.

The fluorinated organic radical is linked to the acid anion either by a direct bond or through the divalent linkage A. Preferably the chain of the linking group A is composed of carbon atoms although heteroatoms, e.g. nitrogen or oxygen, may be present provided they do not interfere with the ionic nature of the surfactant. Preferred linking groups are alkylene groups.

Suitable acid anions $X^{\ominus}$ include carboxylic acid and sulfonic acid groups.

Examples of suitable fluorinated organic radical containing anions $R_f\text{-}A\text{-}X^{\ominus}$ include perfluoropentyl sulfonate and perfluoro-octylcarboxylate.

The quaternary ammonium groups $Z^{\oplus}$ are derived from the corresponding amine. Suitable amines include aliphatic amines and aliphatic cyclic amines, which may optionally be substituted with substituents which will not affect the ionic nature of the surfactant. Preferably the amines contain 2 to 12 carbon atoms. Suitable amines include piperidine, dimethylaminoethanol, morpholine, triethanolamine and triethylamine.

Other suitable surfactants include those containing 2 or more acid anions and quaternary ammonium cations in which the acid anions are bonded directly to the fluorinated organic radical or via one or more linking groups. Preferably the fluorinated organic radical is pendant although it may be present within the molecule as in the case of the amine salts of $(C_2F_4COOH)_2$ and $(C_2F_4SO_3H)_2$. Anionic surfactants containing two or more fluorinated organic radicals may also be used.

The antistatic agent used in the compositions is an ionic salt of an amine. The compounds have the property that they induce conductivity to the surface upon which they are applied. Suitable amines include those from which the quaternary ammonium groups $Z^{\oplus}$ are derived. The anionic portion of the antistatic agent may be chosen from a wide variety of anions including halide, sulfate, aryl sulfonate, aliphatic sulfonate, aryl carboxylate and aliphatic carboxylate. The anions may contain further substituents providing they do not affect the antistatic properties of the compound, for example, the presence of nitrogen atoms and highly fluorinated radicals is undesirable in the anion.

Specific examples of anions include:

$C_7H_7SO_3^{\ominus}$ $SO_4^{\ominus}$ $Cl^{\ominus}$ $CH_3(CH_2)_8CO_2^{\ominus}$ $C_6H_5CO_2^{\ominus}$ $CH_3—CO_2^{\ominus}$ The fluorinated surfactant and antistatic agent may be derived from the same or different amines.

The compositions are preferably applied from a single solution. Suitable solvents include lower alcohols, e.g. ethanol and isopropanol, which may be diluted with a low boiling fluorocarbon. Preferably the solvent is chosen such that the fluorinated surfactant and antistatic agent have substantially the same solubility so that the dried coating contains the same ratio of constituents as in the applied solution. If there is a substantial difference in the solubilities non-uniform coatings may result.

The ratio of fluorinated surfactant to antistatic agent in a composition depends upon the intended use. In the case of compositions to be applied to gramophone records the ratio is adjusted in order to provide low noise antistatic agents. The optimum ratio may readily be ascertained by simple experiment as illustrated in the Examples hereinafter.

The concentration of the solutions vary according to their intended use. In the case of a composition for use on a gramophone record it is desirable to use low coating weights for the dried coating in order to avoid impairing the playback quality e.g. 0.1 to 10 mg for one side of a 12 inch record and therefore dilute solutions, e.g. 0.1% w/v, may be used.

Obviously the solution concentration may vary to obtain the optimum conditions for applying the compounds uniformly over the surface and avoiding the use of large volumes of liquid.

The addition of fluorinated surfactants to the antistatic agents lowers the interfacial tension between the hydrophilic antistatic layer and the hydrophobic surfaces of electrically insulating substrates, e.g. polyester and polyethylene. The fluorinated surfactants lower the surface tension of aqueous ionic solutions to a level where the low energy surfaces of the electrically insulating materials are wetted by the solution. For example, a 2% aqueous solution of the para-toluene sulphonic acid salt of dimethylaminoethyl methacrylate was found to have a surface tension of 48 dynes $cm^{-1}$ at 20° C. This solution did not uniformly wet a polythene surface and portions of the surface were not coated with an antistatic layer after drying. When sufficient of the para-toluene sulphonic acid salt of dimethylaminoethyl methacrylate was added to provide a 0.01% solution of this compound, the surface tension fell to 17.5 dynes $cm^{-1}$. The resulting solution evenly wetted a polythene surface.

The addition of a fluorinated anionic surfactant to an ionic salt of an amine allows the formation of very thin durable antistatic coatings. Continuous films can be formed on transparent or highly polished surfaces, which are sufficiently thin that no surface defects are visible, and these films are sufficiently durable to withstand polishing and normal wear without appreciable loss of conductivity. The formulations are of use in applications where appearance is important. For example, on slides for projection where the conductive layer prevents the electrostatic attraction of dust and fibres, on overhead projector material where the conductive layer prevents electrostatic attraction between the sheets and on transparent covers where the decorative visual effect is important such as acrylic covers for gramophone turntables.

Necessarily, the conductivity of thin films of antistatic material is comparatively low, but in many instances, relaxation times of 10 to 100 seconds for the neutralisation of an electrostatic charge is not a disadvantage, particularly where the requirement is the removal of dust or fibres by wiping with a dry cloth or tissue. We have found that surface resistivities up to $10^{13}$ ohms/square can give relaxation times of this order for triboelectric charges.

The thickness and durability of the antistatic coatings obtained by the addition of a surfactant make them particularly useful when applied to gramophone records. A grooved surface with sharp edges is presented and the low surface energy of the record material makes this application particularly difficult. In addition, the coating must not introduce a high noise level on replay of the record and must withstand the abrasion of the playing stylus. Suitable coating weights generally range from 0.1 to 10 mg, and more usually of the order of 1 mg solids for one side of a 12 inch record. Coating weights below the general range may be insufficient to provide a continuous film of the compounds over the surface and therefore the conductivity and antistatic properties would be reduced. There is no improvement in antistatic properties to be gained with coating weights above the general range and the noise level on replay may rise to an unacceptable level.

Testing on gramophone records revealed that not all fluorocarbon surfactants capable of lowering the surface tension of aqueous solutions gave smooth coatings. The cationic and non-ionic fluorocarbon surfactants gave rise to a high impulse noise level, which was assumed to be due to crystallization of the antistatic agent. Only the fluorinated anionic surfactants gave smooth coatings which did not increase the noise level above that of an untreated record surface.

The antistatic compositions for use on gramophone records may also include a lubricant to reduce friction between the surface of the record and the replay stylus. The reduction of friction increases the life of both the gramophone record and the replay stylus. A suitable lubricant is isocetyl stearate which is commercially available as a mixture of isomers and which may be included in the formation without any deleterious affect on the surfactant or antistatic agent.

The compositions of the invention are also useful on a wide range of other surfaces particularly irregular surfaces, such as carpets. The compositions may be applied with low application rates which do not detract from the visual appearance of the surfaces.

The solubility of both amine salts in isopropanol, for example, allows the formation of a dry coating with approximately the same ratio of constituents as in the applied solution.

The invention will now be illustrated by the following Examples.

EXAMPLE 1

A solution of 0.073 g of piperidinium para-toluene sulfonate and 0.027 g of piperidinium perfluoro-octyl sulfonate in 100 ml isopropanol was prepared giving a 0.1% w/v solution of the constituents in a molar ratio of 6 to 1 (85.7 and 14.3 molar percent) respectively. One milliliter of this solution was applied to one side of a 12" microgroove gramophone record and the liquid was spread over the surface with a velvet pad or soft paper tissue to provide a coating weight of approximately 1 mg of solids for one record side. The solution was allowed to dry under ambient conditions at a relative humidity of 42 to 45% at 18° C.

The surface resistivity was measured on several areas of the treated surface using a Keithley 6105 Adaptor and was found to have a value of $9.7\times10^{10}$ ohms/square. The record was left under the same ambient conditions for 24 hours, but no change in the surface resistivity was found. The surface resistivity of untreated gramophone records was greater than $10^{15}$ ohms/square.

The treated side of the record was played on a normal sound reproducing apparatus and the surface noise of the treated record was assessed subjectively as comparable to the surface noise from an untreated copy of the same record.

The treated side of the record was then played for a total of 74 times under ambient conditions of 15° to 18° C. at relative humidity of 42 to 45%. The downward force of the playing stylus was 1.5 g throughout the test. After this test the surface resistivity of the treated surface was found to be $3.33\times10^{11}$ ohms/square. The surface noise on playing the record through sound reproducing apparatus was again subjectively assessed as being comparable to the surface noise from a new, untreated copy of the same record.

The subjective level of surface noise in this Example and subsequent Examples was related to an arbitrary scale of 1 to 5:

Level 1 represented the lowest surface noise level comparable to that from a high quality direct cut recording.

Level 2 represented the noise level on a standard commercial record pressing in the absence of any surface treatment.

Levels 3, 4 and 5 represented successive degradation of the signal by impulse noise with level 5 corresponding to a continuous crackling at amplitudes comparable to lower levels of the recorded signal.

The tests were repeated replacing piperidine with other amines. In each case, the molar ratio of the p-toluene sulfonate to the perfluoro-octyl sulfonate salts of the amine was maintained at 6:1 and in each case, the coating weight was approximately 1 mg of the mixture solids for one side of a gramophone record. The results of the tests are reported in Table 1.

TABLE 1

| Amine | Initial Resistivity ohms/square | No. of Plays | Final Resistivity | Sound Quality |
|---|---|---|---|---|
| Piperidine | $9.7\times10^{10}$ | 74 | $3.33\times10^{11}$ | 2 |
| Triethylamine | $1.34\times10^{11}$ | 74 | $2.78\times10^{12}$ | 2 |
| Dodecylamine | $5.13\times10^{12}$ | 66 | $6.7\times10^{13}$ | 2 |
| Dimethylamino-ethanol | $1.5\times10^{11}$ | 70 | $3.8\times10^{13}$ | 2 |

TABLE 1-continued

| Amine | Initial Resistivity ohms/square | No. of Plays | Final Resistivity | Sound Quality |
|---|---|---|---|---|
| Dimethylamino-ethylmethacrylate | $6.6\times10^{10}$ | 74 | $22.4\times10^{13}$ | 2 |
| Morpholine | $1.78\times10^{11}$ | 75 | $5.34\times10^{12}$ | 2 |
| Triethanolamine | $2.4\times10^{11}$ | 64 | $1.8\times10^{12}$ | 2 |

The surface resistivity of copies of the gramophone record was measured with a Keithley 6105 Adaptor at 42 to 45% relative humidity.

The amines were all protonated with 85.7% molar parts of p-toluene sulfonic acid and 14.3% $C_8F_{17}SO_3H$.

The results show that no increase in surface noise of records was generated by crystallization of either of the components of the antistatic coating.

EXAMPLE 2

The effect of varying the ratio of the fluorocarbon anion to the p-toluene sulfonate anion was investigated. The tests were conducted as in Example 1 using dimethylaminoethyl methacrylate as the amine and the results are reported in Table 2.

TABLE 2

| Anion molar % of $C_7H_7SO_3^{\ominus}$ | Anion molar % of $C_8F_{17}SO_3^{\ominus}$ | Resistivity ohms/square | Sound Quality |
|---|---|---|---|
| 100 | 0 | $4.4\times10^{12}$ | 5 |
| 98.2 | 1.8 | $9.3\times10^{11}$ | 5 |
| 96.4 | 3.6 | $3.14\times10^{11}$ | 5 |
| 92.85 | 7.15 | $2.5\times10^{11}$ | 5 |
| 85.7 | 14.3 | $6.6\times10^{10}$ | 2 |
| 57.1 | 42.9 | $1.34\times10^{12}$ | 5 |
| 14.3 | 85.7 | $3.5\times10^{13}$ | 4 |
| 0 | 100 | $>10^{15}$ | 4 |

In general, the recorded signal was degraded by ratios other than that described in Example 1. In particular, a coating of 1 mg of dimethylaminoethyl methacrylate gave a high surface noise and the durability of the coating was poor. The surface resistivity with this coating increased from $4.4\times10^{12}$ ohms/square to $1.8\times10^{14}$ ohms/square after 7 plays at 42% relative humidity.

A coating of 1 mg of the perfluoro-octyl sulfonic acid salt of dimethylamino-ethyl methacrylate also gave a high surface noise and gave a surface resistivity which could not be measured with the Keithley Adaptor and was undistinguishable from an untreated record in respect of static charging. The audio quality of the records giving bad surface noise characteristics was examined after the coating had been removed by washing the isopropanol. In all cases, the audio quality was comparable to an untreated copy of the record showing that the noise was due to the coating and not to physical damage of the record surface during the coating process.

EXAMPLE 3

The use of other anions in place of the p-toluene sulfonate anion described in Examples 1 to 2 was investigated. The coating composition used was as in Example 1 with the exception that the p-toluene sulfonate anion was replaced by those listed in Table 3. The surface resistivities for copies of the same record coated with 1 mg of amine salts with the molar ratio of perfluoro-octyl sulfonate anion to other anion maintained at 1:6 are reported in Table 3.

TABLE 3

| Amine | 85.7% anion 14.3% $C_8F_{17}SO_3^{\ominus}$ | Initial Resistivity ohms/square |
|---|---|---|
| Piperidine | $C_7H_7SO_3^{\ominus}$ | $9.7 \times 10^{10}$ |
| Piperidine | $SO_4^{2\ominus}$ | $2.67 \times 10^{10}$ |
| Piperidine | $Cl^{\ominus}$ | $1.4 \times 10^{11}$ |
| Dimethylaminoethanol | $CH_3(CH_2)_8CO_2^{\ominus}$ | $2.6 \times 10^{12}$ |
| Morpholine | $C_7H_7SO_3^{\ominus}$ | $1.78 \times 10^{11}$ |
| Morpholine | $C_6H_5CO_2^{\ominus}$ | $8.9 \times 10^{13}$ |
| Morpholine | $CH_3-CO_2^{\ominus}$ | $2.7 \times 10^{14}$ |
| Triethanolamine | $C_7H_7SO_3^{\ominus}$ | $2.43 \times 10^{12}$ |
| Triethanolamine | $C_6H_5CO_2^{\ominus}$ | $2.67 \times 10^{14}$ |
| Triethanolamine | $CH_3CO_2^{\ominus}$ | $2.67 \times 10^{13}$ |

The results shown in Table 3 may be rearranged to show the uniformity of the coatings obtained with the mixture as described in Example 1. The coatings are sufficiently thin and sufficiently uniform for the surface resistivities of copies of the same record to show a relationship to the difference between the pka of the amine and non-fluorocarbon anion used in the coating. This is in accordance with increase in the ionic nature of the solution with increasing difference in the pka of the acid and base. This correlation between pka and surface resistivity is shown in Table 4.

TABLE 4

| Amine | 85.7% Anion 14.3% $C_8F_{17}SO_3$ | Δpka | Initial Resistivity ohms/square |
|---|---|---|---|
| Piperidine | $SO_4^{2\ominus}$ | >12 | $2.67 \times 10^{10}$ |
| Piperidine | $C_7H_7SO_3^{\ominus}$ | 10.3 | $9.70 \times 10^{10}$ |
| Triethylamine | $C_7H_7SO_3^{\ominus}$ | 10.2 | $1.34 \times 10^{11}$ |
| Morpholine | $C_7H_7SO_3^{\ominus}$ | 7.5 | $1.78 \times 10^{11}$ |
| Triethanolamine | $C_7H_7SO_3^{\ominus}$ | 6.9 | $2.43 \times 10^{12}$ |
| Dimethylamino-ethanol | $CH_3(CH_2)_8CO_2^{\ominus}$ | 4.37 | $2.60 \times 10^{12}$ |
| Morpholine | $C_6H_5CO_2^{\ominus}$ | 4.14 | $8.90 \times 10^{13}$ |
| Triethanolamine | $C_6H_5CO_2^{\ominus}$ | 3.50 | $2.67 \times 10^{14}$ |
| Morpholine | $CH_3CO_2^{\ominus}$ | 3.58 | $2.70 \times 10^{14}$ |
| Triethanolamine | $CH_3CO_2^{\ominus}$ | 2.95 | $2.67 \times 10^{13}$ |

EXAMPLE 4

Different amines may be used for the surfactant and antistatic agent. A solution of 0.08 g of the paratoluene sulfonic acid salt of dimethylaminoethyl methacrylate and 0.02 g of the perfluoro-octyl sulfonic acid salt of 1-(4-isopropylphenyl)ethylamine in 10 ml ethanol and 90 ml of isopropanol was prepared. One milliliter of this solution was used to treat one side of a gramophone record as described in Example 1. The initial surface conductivity was found to be $4\times10^{11}$ ohms/square and this increased to $3.2\times10^{12}$ ohms/square after 100 playings. The surface resistivities were measured at relative humidity 42%. The subjective assessment of surface noise was that the record before and after playing, was comparable to an untreated copy of the same record.

EXAMPLE 5

The information retrieval from treated and untreated records was compared using records coated with 1 mg on each side of the mixture of the para-toluene sulfonic acid salt of dimethylaminoethyl methacrylate and the perfluoro-octyl sulfonic acid salt of 1-(4-isopropylphenyl)ethylamine described in Example 4. A copy of a record modulated with one third octave bands of pink noise centered at frequencies ranging from 40 Hz to 16 kHz was treated with the mixture in the manner described in Example 1. The amplitude of the signal generated in a pick-up cartridge by each band was compared with the amplitude generated by the corresponding band on an untreated copy of the same record using the same replay apparatus. No significant difference was found between the treated and untreated records and it was concluded that the frequency response of the signal recovered from the treated record had not been altered. The downward force on the stylus was maintained at 1.5 g during the tests.

The harmonic distortion of treated and untreated records was compared by the methods described for use with the test record TTR-103 distributed by Shure Bros. Inc. One copy of the test was treated with the antistatic composition as described above. The harmonic content in the signal generated in a pick-up cartridge by the treated record was compared with the corresponding signal from an untreated record using a Hewlett Packard Frequency Analyser. No significant difference was found between the signals. Both records were played 100 times and the signals were again compared and again showed no significant difference. In addition it was noted that differences between the signals from both records on the first playing and the hundredth playing were not significant. A downward force on the stylus of 1.5 g was again used.

From these tests is was concluded that no detectable degradation of the retrieved information from the records treated with the antistatic composition had occurred.

EXAMPLE 6

A solution of 0.08 g of the para-toluene sulfonic acid salt of dimethylaminoethyl methacrylate and 0.02 g of the perfluoro-octyl sulfonic acid salt of 1-(4-isopropylphenyl)ethylamine in a mixture of 25 ml of isopropanol and 75 ml of Freon 113 was prepared. One milliliter of this solution was applied to one side of a gramophone record by spraying from a metering hand pump which delivered 0.2 ml of liquid for each action of the pump. The Freon 113 evaporated rapidly and the residual solution was spread over the surface of the record with a velvet pad. After drying the surface resistivity and surface noise were the same as those described in Example 4 when measured under the same conditions.

The surface resistivities shown for the antistatic formulations described above allow the neutralisation of the charge on a gramophone record in less than 15 seconds when the record surface is rubbed with a moleskin. The antistatic formulations described allow the charging and discharging process to be repeated indefinitely without change in the end result. Discharge of the records may normally be accomplished by contact with the thumb or fingers at the edge of the record or by brushing the surface of the record with a carbon fibre brush held in the hand. These methods are not reliable for persons with a high skin resistance but gramophone records were reliably discharged by placing them on an earthed conductive turntable mat.

The major advantages gained from the application of a conductive coating to gramophone records is that it allows the removal of particles of dust from the surface of the record. In the absence of a conductive coating small parties are firmly attached to the record surface by electrostatic attraction and cannot be removed by brushing the dry surface. These dust particles give rise to impulse noise on playback by displacement of the stylus. In general the impulse noise generated by spark discharge from the surface of a charged record to the pick-up is negligible in a correctly earthed system. The provision of a conductive coating on the surface of the record allows neutralisation of electrostatic charges created by the formation of electrets within the material of the record during pressing, in addition to the neutralisation of charges generated by contact electrification of the record surface.

A second benefit arising from the removal of dust particles from the record surface, is the increase in playing life of the record at high standards of fidelity. Physical damage to the recording may arise from the impression of particles into the surface of the modulated groove by the stylus during playing or by particles being scraped across the surface during removal and replacement of the record from its storage sleeve.

EXAMPLE 7

A further modification of the antistatic formulation relating to the use on gramophone records or similar systems is the inclusion of a lubricant to reduce friction between the surface of the record and the replay stylus. The reduction of friction is of obvious utility in extending the useful life of both the record and the replay stylus.

An apparatus for tracing the modulation groove on gramophone records was constructed such that the drag between the record surface and the replay stylus was measured by means of strain gauges and the results were plotted on a pen recorder. In addition to the small variations in drag due to the modulation of the groove, a considerable reduction in the drag was observed when a lubricant was spread over the surface of the record. Isocetyl stearate was found to be an effective lubricant in this context.

A solution of 0.08 g of the para-toluene sulfonic acid salt of dimethylaminoethyl methacrylate and 0.02 g of the perfluoro-octyl sulphonic acid salt of 1-(4-isopropylphenyl)ethylamine and 0.01 g of isocetyl stearate in 100 ml isopropanol was prepared. 0.5 ml of this solution was applied to one side of a gramophone record to give a treated 180° segment, the remaining 180° segment therefore remaining untreated. The difference in drag between the treated and untreated portions of the recording was estimated using the apparatus above described. It was found that the treated half of the record displayed a reduction of approximately 40% in drag when compared to the untreated half. The surface resistivity of the treated portion of the record was $1.78\times10^{11}$ ohms/square at 42% when measured with a Keithley 6105 Adaptor.

The noise level of records coated with approximately 1.1 mg of the composition described above was subjectively assessed as at least as good as untreated copies of the same records.

The same results were obtained when the three components described above were coated from a solvent comprising 25% isopropanol and 75% Freon 113.

A further test of the effect of a lubricant on frictional drag between the record surface and the stylus was made by comparing the downward force on the stylus required to maintain good tracking of the groove modulation on treated and untreated records. The record HFS75 carries a modulated grooves intended to aid the setting of the downward force and bias force for a given pick-up and stylus assembly. The most stringent test is on the groove on the inner edge of the playing surface. Using a standard record playing deck it was found that a downward force of 2 g and a corresponding setting of the bias force was required to trace this groove accurately on an untreated record.

The same record was then coated with one milliliter of a solution of 0.073 g of piperidinium toluene sulfonate, 0.027 g of piperidinium perfluoro-octyl sulfonate and 0.01 g of isocetyl stearate in 100 ml of isopropanol in the manner described in Example 1. The downward force required to trace the groove to the same accuracy was found to be 1.5 g and it was observed that the bias force setting was less critical than for the untreated record.

The surface conductivity of a record treated with the antistatic and lubricant combination described above was $8.9\times10^{11}$ ohms/square at 42% relative humidity.

The reduction in downward force required to trace a recorded modulation can be of benefit in one of two ways. Firstly the downward force on the stylus can be reduced by 25% when playing records treated with the antistatic lubricant combination to achieve the same fidelity with reduced wear of the record and stylus. Alternatively the original downward force can be used to improve the tracing ability of the stylus assembly at high levels of modulation.

EXAMPLE 8

A gold Burlington carpet was treated with a 1.0% solution in isopropanol of the para-toluene sulfonic acid salt of dimethylaminoethyl methacrylate and the perfluoro-octyl sulfonic acid salt of isopropyl phenyl ethylamine in a 6 to 1 molar ratio. The solution was applied to the carpet by wet pick-up from a bath.

When the carpet was subjected to the standard AATCC test of being walked on with neolite and chrome leather shoes the static charge which built up on the carpet was 2 kV. For an untreated carpet the charge was in excess of 12 kV for a similar test. All tests were carried out at 70° C. and 22% relative humidity.

A much lower coating weight may also give significant static protection. A 2×3 ft. 50 oz/yd$^2$ cut pile carpet was sprayed with approximately 0.5 oz. of a 0.1% solution of the above antistat.

For similar testing with mixtures of the following materials in a 6:1 molar ratio as a 1.0% solution, no static potentials above 4 kV were seen.

| | | |
|---|---|---|
| (a) | Para-toluene sulfonic acid salt of isopropyl phenyl ethylamine/ | 6 |
| | Perfluoro-octyl sulfonic acid salt of isopropyl phenyl ethylamine | 1 |
| (b) | Piperidinium toluene sulfonate | 6 |
| | Piperidinium . perfluoro-octyl sulfonate | 1 |
| (c) | Morpholinium toluene sulfonate | 6 |
| | Morpholinium perfluoro-octyl sulfonate | 1 |
| (d) | Para-toluene sulfonic acid salt of dimethylaminoethyl methacrylate/ | |
| | Perfluoro-octyl sulfonic acid salt of dimethylaminoethyl methacrylate in a 4:1 mixture by weight. | |

The concept was air dried and conditioned for 72 hours at 70° F. and 12% relative humidity.

For chrome leather shoes the AATCC step test gave 4.6 kV and the neolite shoes 6.3 kV.

EXAMPLE 9

A 42 oz/yd$^2$ latex backed gold and brown nylon carpet was treated with a series of antistatic compositions in accordance with the invention. The carpet was wet out prior to testing by running the wet carpet through squeeze rollers to remove the excess water. Solutions of the antistatic compositions were top sprayed onto the carpet samples to deliver a a wet pick-up of 12% based on the weight of the face pile fibre.

The samples were conditioned for 48 hours at 70°±2° F. and 20±2% relative humidity. The test consisted of demagnetising, stepping and recording. The principal of the test was to demagnetise the carpet to zero kilo volts. The tester wearing chrome leather shoes, walked normally over the surface of a 27"×36" carpet sample lifting his feet 3" and placing them flat with each step. This action was performed for 30 seconds while holding the probe of an electrometer. The highest KV value observed on the meter was recorded. An acceptable number for the step test is 3.0 KV. The same procedure was repeated wearing shoes with neolite soles.

A scuff test was also performed. This test is a more sever evaluation of static build-up. The tester wearing shoes having neolite soles walked in a backward scuffing motion for 45 seconds and the highest KV value observed. A value of 4.0 KV or less is considered to be the comfortable range of static propensity for the scuff test.

The following compositions were tested:

A. 2-(N,N-dimethylammonium)ethyl methacrylate p-toluene sulfonate and 1-(4-isopropylphenyl)ethylammonium perfluoro-octyl sulfonate (weight ratio 4:1), B. 1-(4-isopropylphenyl)ethylammonium p-toluene sulfonate and 1-(4-isopropylphenyl)ethylammonium perfluoro-octyl sulfonate (molar ratio 6:1), C. Piperidinium p-toluene sulfonate and piperidinium perfluoro-octyl sulfonate (molar ratio 6:1), D. Morpholinium p-toluene sulfonate and morpholinium perfluoro-octyl sulfonate (molar ratio 6:1), E. 2-(N,N-dimethylammonium)ethyl methacrylate p-toluene sulfonate and 2-(N,N-dimethylammonium-)ethyl methacrylate p-toluene sulfonate (weight ratio 4:1).

The compositions were tested as a 1% solids solution in methanol.

The results are reported in the following Table 5.

TABLE 5

| | Initial Step Test | | Initial Scuff Test | | Scuff Test after aging one month |
|---|---|---|---|---|---|
| Composition | C | N | C | N | N |
| A | 0.15 | 0.6 | 0.2 | 2.5 | 4.0 |
| B | 0.2 | 0.6 | 1.9 | 3.0 | 4.0 |
| C | 0.3 | 0.4 | 2.2 | 3.0 | 2.0 |
| D | 0.1 | 0.3 | 0.3 | 2.0 | 4.0 |
| E | 0.1 | 0.3 | 2.0 | 2.3 | 2.0 |
| Untreated | 2.5 | 6.0 | 3.0 | 12.0 | 4.5 |

What is claimed is:

1. An antistatic composition comprising a mixture of (1) a fluorinated anionic surfactant, which surfactant is an amine salt of an acid containing a fluorinated organic radical, with (2) an antistatic agent, which agent is an ionic salt of an amine and an acid without a fluorinated organic radical wherein the anion molar % of the fluorinated organic radical is between 1.8% and 42.9% of the mixture.

2. An antistatic composition according to claim 1 wherein the fluorinated anionic surfactant has the formula:

$$R_f\text{-}A\text{-}X^{\ominus}Z^{\oplus}$$

wherein $R_f$ represents a fluorinated organic radical,

A is selected from the group consisting of a bond or divalent linking group, $X^{\ominus}$ represents an acid anion, and $Z^{\oplus}$ represents a quaternary ammonium cation.

3. An antistatic composition according to claim 2 wherein $R_f$ represents a perfluoroalkyl radical having 2 to 20 carbon atoms and $X^{\ominus}$ is selected from the group consisting of a carboxylic acid group and sulphonic acid group.

4. An antistatic composition according to claim 2 wherein $R_f\text{-}A\text{-}X^{\ominus}$ is selected from perfluoropentyl carboxylate and perfluoro-octylsulfonate.

5. An antistatic composition according to claim 2 wherein $Z^{\oplus}$ is derived from an amine selected from the group consisting of piperidine, dimethylaminoethanol, morpholine, triethanolamine and triethylamine.

6. An antistatic composition according to claim 1 wherein said antistatic agent has an anionic portion selected from the group consisting of halide, sulphate, aryl sulphonate, aliphatic sulphonate, aryl carboxylate and aliphatic carboxylate.

7. An antistatic composition according to claim 6 wherein said anionic portion is selected from the group consisting of $C_7H_7SO_3^{\ominus}$, $SO_4^{\ominus}$, $Cl^{\ominus}$, $CH_3(CH_2)_8CO_2^{\ominus}$, $C_6H_5CO_2^{\ominus}$, and $CH_3—CO_2^{\ominus}$.

8. An antistatic composition according to claim 7 wherein said antistatic agent is a salt of an amine selected from the group consisting of piperidine, dimethylaminoethanol, morpholine, triethanolamine and triethylamine.

9. An antistatic composition according to claim 1 wherein said fluorinated anionic surfactant and antistatic agent are derived from the same amine.

10. An antistatic composition according to claim 1 wherein said fluorinated anionic surfactant and antistatic agent are dissolved in a solvent.

11. An antistatic composition according to claim 10 wherein said solvent comprises a lower alkanol.

12. An antistatic composition according to claim 10 for treating gramophone records which additionally comprises, as lubricant, isocetyl stearate.

13. An antistatic composition according to claim 1 wherein the molar ratio of fluorinated anionic surfactant to antistatic agent is about 1:6.

14. An antistatic composition according to claim 10 wherein the amount of fluorinated anionic surfactant and antistatic agent is about 0.1% w/v.

15. A method of treating a surface to reduce the static charging thereon which comprises applying to said surface a mixture of (1) a fluorinated anionic surfactant which is an amine salt of an acid containing a fluorinated organic radical and (2) an antistatic agent which is an ionic salt of an amine and an acid without a fluorinated organic radical wherein the anion molar % of the fluorinated organic radical is between 1.8% and 42.9% of the mixture.

16. A method according to claim 15 wherein the fluorinated anionic surfactant has the general formula:

$$R_f\text{-}A\text{-}X^{\ominus}Z^{\oplus}$$

wherein $R_f$ represents a fluorinated organic radical,

A is selected from a bond or divalent linking group, $X^{\ominus}$ represents an acid anion, and $Z^{\oplus}$ represents a quaternary ammonium cation.

17. A method according to claim 16 wherein $R_f$ represents a perfluoroalkyl radical having 2 to 20 carbon atoms and $X^{\ominus}$ is selected from a carboxylic acid group and sulphonic acid group.

18. A method according to claim 16 wherein $R_f$-A-$X^{\ominus}$ is selected from perfluoropentyl carboxylate and perfluoro-octylsulfonate.

19. A method according to claim 16 wherein $Z^{\oplus}$ is derived from an amine selected from the group consisting of piperidine, dimethylaminoethanol, morpholine, triethanolamine and triethylamine.

20. A method according to claim 15 wherein said antistatic agent has an anionic portion selected from the group consisting of halide, sulfate, aryl sulfonate, aliphatic sulfonate, aryl carboxylate and aliphatic carboxylate.

21. A method according to claim 20 wherein said anionic portion is selected from the group consisting of $C_7H_7SO_3^{\ominus}$, $SO_4^{\ominus}$, $Cl^{\ominus}$, $CH_3(CH_2)_8CO_2^{\ominus}$, $C_6H_5CO_2^{\ominus}$ and $CH_3—CO_2^{\ominus}$.

22. A method according to claim 21 wherein said antistatic agent is a salt of an amine selected from the group consisting of piperidine, dimethylaminoethanol, morpholine, triethanolamine and triethylamine.

23. A method according to claim 15 wherein said fluorinated anionic surfactant and antistatic agent are derived from the same amine.

24. A method according to claim 15 wherein said fluorinated anionic surfactant and antistatic agent are applied in a solvent which is thereafter evaporated.

25. A method according to claim 24 wherein said solvent comprises a lower alkanol.

26. A method according to claim 24 wherein the molar ratio of fluorinated anionic surfactant to antistatic agent is about 1:6.

27. A method according to claim 24 wherein the amount of fluorinated anionic surfactant and antistatic agent is about 0.1% w/v.

28. A method according to claim 24 wherein said surface is a gramophone record and isocetyl stearate is applied as a lubricant incorporated in said solution of surfactant and antistatic agent.

29. A method according to claim 15 wherein said surface is a carpet.

30. A method according to claim 15 wherein said surface is selected from the group consisting of an acrylic cover for gramophone turntables, a slide for projectors, and sheets for use with overhead projectors.

* * * * *